US007347395B2

(12) United States Patent
Horn

(10) Patent No.: US 7,347,395 B2
(45) Date of Patent: Mar. 25, 2008

(54) BOX FOR TRANSPORTATION AND DISPENSING ITEMS TO BE USED IN GARAGES

(75) Inventor: Jörg Horn, Schwalmstadt (DE)

(73) Assignee: Horn & Bauer GmbH & Co. KG, Schwalmstadt (DE)

( * ) Notice: Subject to any disclaimer, the term of this patent is extended or adjusted under 35 U.S.C. 154(b) by 420 days.

(21) Appl. No.: 11/096,045

(22) Filed: Mar. 31, 2005

(65) Prior Publication Data

US 2006/0163419 A1 Jul. 27, 2006

(30) Foreign Application Priority Data

Apr. 2, 2004 (DE) ..... 10 2004 016 269

(51) Int. Cl.
*B65H 16/06* (2006.01)

(52) U.S. Cl. ..... 242/598.5; 242/598.6; 242/592

(58) Field of Classification Search ..... 242/598.3, 242/598.5, 598.6, 592
See application file for complete search history.

(56) References Cited

U.S. PATENT DOCUMENTS

| | | | |
|---|---|---|---|
| 2,428,073 | A | 9/1947 | Handel |
| 2,936,937 | A | 5/1960 | Guyer |
| 3,302,781 | A | 2/1967 | Rudnick |
| 3,317,099 | A | 5/1967 | Solomon |
| 3,477,624 | A | 11/1969 | Branyon et al. |
| 3,530,980 | A | 9/1970 | Link |
| 3,565,307 | A | 2/1971 | Wiley et al. |
| 3,698,548 | A | 10/1972 | Stenzel et al. |
| 4,094,416 | A | 6/1978 | Smith |
| 4,269,317 | A | 5/1981 | Rubenstein et al. |

(Continued)

FOREIGN PATENT DOCUMENTS

| | | |
|---|---|---|
| DE | 29 07 896 | 9/1979 |

(Continued)

OTHER PUBLICATIONS

European Search Report, Jun. 9, 2006, 4 pages.
European Search Report, Oct. 23, 2003, 4 pages.

*Primary Examiner*—John Q. Nguyen
(74) *Attorney, Agent, or Firm*—Thomas, Kayder, Horstemeyer & Risley, LLP

(57) ABSTRACT

A box for supplying items to be used in garages includes a portion being made of cardboard, a plurality of side walls and of front walls. The items may be seat covers, steering wheel covers, floor carpets, trash bags, replacement parts bags, foils for sealing the interior of doors and bags for tires and the like. An axle is passed through openings of the transportation and dispenser box and through a roll of the items wound up on a bobbin. The box is mounted and fixed with the environment by means of a holding device. The holding device includes parallel side arms with guideways being inclined with respect to a vertical axis. For an assembly the axle is introduced into the guideways and moves by gravity along the guideways in a sliding motion. In a dispensing position, the contact area of the transportation and dispenser box abuts a corresponding supporting area of the holding device, so that the box is secured against rotation during pulling off the items from the transportation and dispenser box. Additional securing means are possible but not necessary.

10 Claims, 5 Drawing Sheets

U.S. PATENT DOCUMENTS

| | | | | |
|---|---|---|---|---|
| 4,274,573 | A | 6/1981 | Finkelstein | |
| 4,444,313 | A | 4/1984 | Tyson | 206/397 |
| 4,451,010 | A | 5/1984 | Meyer | 242/55.53 |
| 4,773,532 | A | 9/1988 | Stephenson | |
| 5,409,181 | A | 4/1995 | Patrick | 242/596.2 |
| 5,503,292 | A | 4/1996 | Cuccharia | |
| 5,618,008 | A | 4/1997 | Dearwester et al. | 242/594 |
| 5,688,394 | A | 11/1997 | McBride, Jr. et al. | |
| 5,971,150 | A | 10/1999 | Anderson et al. | |
| 6,283,405 | B1 | 9/2001 | Tracy | |
| 6,290,169 | B1 | 9/2001 | Hartley | 242/588.6 |
| 6,564,942 | B1 | 5/2003 | Shiffler et al. | |
| 2002/0074375 | A1 | 6/2002 | Irwin | |
| 2003/0090181 | A1 | 5/2003 | Horn | |
| 2004/0016668 | A1 | 1/2004 | Horn | |

FOREIGN PATENT DOCUMENTS

| | | | |
|---|---|---|---|
| DE | 33 31 171 | | 3/1985 |
| DE | 89 02 641.1 | | 6/1989 |
| DE | 89 06 585 | U | 7/1989 |
| DE | 198 19 507 | A | 4/1998 |
| DE | 299 03 274 | | 2/1999 |
| FR | 644363 | | 11/1927 |
| FR | 2 681 846 | A | 4/1993 |
| GB | 181107 | | 3/1921 |
| GB | 1 367 827 | | 9/1974 |
| GB | 1 518 913 | A | 7/1978 |
| GB | 2 036 707 | | 7/1980 |
| GB | 2 295 374 | | 11/1994 |
| GB | 2 372 736 | | 4/2002 |
| JP | 10286836 | | 10/1998 |

BOX FOR TRANSPORTATION AND DISPENSING ITEMS TO BE USED IN GARAGES

CROSS REFERENCE TO RELATED APPLICATIONS

This application claims priority to co-pending German Patent Application No. DE 10 2004 016269.7 entitled "Einrichtung zum Transport, zur Aufnahme und einzelnen Abgabe von flexiblen Verbrauchsartikeln in Kraftfahrzeugwerkstätten", filed Apr. 2, 2004.

FIELD OF THE INVENTION

The present invention generally relates to an assembly for containing, protecting and dispensing flexible items for use in garages and the like. Furthermore, the invention relates to a box configured and designed to be used in the aforementioned assembly.

In garages items have to be stored and have to be dispensed to a user as a mechanic. The items can be one or several of the group of articles of plastic foils used during or in the end of manufacturing of vehicles or in workshops in order to protect parts of the vehicle against contamination or dirt. In particular, the items are seat covers made of plastic foil, one-way floor carpets, steering wheel covers made of foil, bags for spare or replacement parts, foils for an interior sealing of the door of a vehicle, bags of plastic for receiving at least one tire and the like. Other items could be made of paper, cardboard, corrugated board or tissue and can be used for cleaning purposes. A plurality of items can be interconnected by means of detachable connections or by means of perforations of the base material building the items. Most commonly, the interconnected items are wound up on a core which is removed afterwards or on a bobbin to build a roll. The roll is stored in a box being designed and arranged for transportation, containing, protecting and dispensing said items. In case of said box having a fixed position in a garage, a holding device is provided which is mounted with a wall of the garage. The holding device aims to position the box in a dispensing position.

BACKGROUND OF THE INVENTION

U.S. Patent Application No. US 20030090181 A1 by the applicant discloses an assembly with a roll of articles which both in a transportation position and a dispensing position is protected by means of a box. The box is mounted to a wall by means of a holding device. The holding device includes two hook-shaped elements being arranged horizontally distant. The hook-shaped elements protrude from the holding device. The box comprises openings in the rearward wall wherein the distance of the openings corresponds to the distance of the hook-shaped elements. For connecting the holding device and the box the hook-shaped elements are received by the openings. Inside the box the hook-shaped elements engage with the rearward wall of the box. Both the weight of the box as well as the weight of the roll are supported by means of the hook-shaped elements and the rearward wall of the box. In order to avoid a rotation of the box with respect to an axis extending through the contact areas between the hook-shaped elements and the box, the box comprises a contacting area built by the rearward wall. Such contact area contacts a corresponding supporting area of the holding device. The cooperating contact area and supporting area serve for aligning the box with respect to the holding device. Furthermore, when dispensing articles from the box in a dispensing position, the aforementioned areas serve to produce reacting contact forces that counteract a rotation of the box during dispensing the items.

British Patent Application No. GB 2 372 736 A discloses a holding device for containing and dispensing items wound up to a roll, wherein the items are plastic bags for supermarkets. The items are wound up on a stiff core. The core protrudes out of the roll. The core is guided by guideways of side arms of the holding device, wherein the guideways are inclined with respect to a vertical axis with an angle between 0° and 90°. The outer surface of the roll is supported by a plate. Due to frictional forces between plate and roll a free or an easy rotation of the roll is spoiled.

SUMMARY OF THE INVENTION

The present invention relates to an assembly including a holding device with an axle rotatably supporting a roll. Additionally, the holding device includes side arms extending approximately perpendicular to the axle. The side arms include guideways being inclined with respect to a vertical axis at an angle between 0° and approximately 90°. The guideways are adapted and configured for receiving the axle. Front walls of the box include openings, markers or the like being aligned with each other and being centered with respect to the front walls. The axle may be inserted through the front walls in the region of the openings and may be passed through the roll. The weight of the roll is divided into two components, wherein the first component is supported by a contact area between the box and the holding device or a wall of the garage and the second component is supported by means of the axle, so that in a dispensing position the box is secured against rotation.

The maximum weight of a roll being supported with respect to a holding device by means of common assemblies, cp. document US 20030090181 A1, depends on the mechanical properties of the base material of the box, in particular cardboard. This is due to the fact that embodiments according to document US 20030090181 A1 base on the characteristic feature that the full weight of the roll is supported by the rearward wall of the box. In some cases the weight of the roll can exceed 15 kg.

The novel assembly supports the weight of the roll not only by means of the rearward wall but also by means of the axle or guiding shaft, which is located in the hollow interior of the roll and which contacts the roll itself or a hollow bobbin or a core. According to an alternative embodiment of the present invention, a supporting element is interposed between the roll and the axle so that the roll is indirectly supported by means of the axle.

The weight of the roll is divided into a first supporting component, which is orientated transverse to the guideway and which is directly supported by the guideway, and a second supporting component, which is oriented in the direction of the guideway and which is directly or indirectly supported by means of the contacting area of the box. The contacting areas between box and holding device are only subjected with the second supporting component which is smaller than the whole weight of the roll. Accordingly, the maximum force acting upon the box correlates with the second supporting component. The relation between the second supporting component and the weight and the first component is a choice of the design and depends on the angle of the guideways with respect to a vertical axis: in case that the guideway is approximately perpendicular to the contacting area of the holding device, (i.e. oriented in the horizontal direction), the second component is minimal and tends to 0, so that all the weight of the roll is supported by the guideways. With a change of the angle of the guideway versus the vertical axis the second component increases, so that also the contact force of the box in the contact areas of the holding device increases. The supporting force acting upon the walls of the box can be designed dependent on the angle of the guideway with respect to the vertical axis.

In a similar manner dispensing forces caused by a user during dispensing items from the roll are divided into a first supporting component of the guideway and a second supporting component of the contact areas. If the guideways are oriented transverse to the pulling direction during dispensing the items pulling forces will mainly be supported by the guideway. When the pulling forces not being directed versus the axle, bending moments acting upon the box due to the pulling forces lead to a non-uniform distribution of force in the contact area of the box so that a counter-moment is produced which counteracts in undesired rotation of the box.

One embodiment of the invention provides for a very simple assembly and replacement of a box: in a first step of assembly the axle is passed through the openings, the box and the roll. In a next step of assembly the axle is inserted into the guideways or is positioned in the beginning of the guideways. Due to the fact that the guideways are inclined by an angle between 0° and 90° with respect to a vertical axis, gravity moves the box, the axle and the roll along the guideways. The aforementioned motion is stopped automatically in an end position which is the dispensing position, wherein the contact area of the box abuts a supporting area of the holding device or the environment. Without any additional steps of adjusting or fine adjustments, without steps for securing and without additional fixing elements the box is positioned and fixed in the dispensing position.

Furthermore, according to one embodiment of the invention one single holding device can be used for supporting boxes of different lengths and/or cross-sections without the need of any adjusting works. In order to decrease or increase the distance of the contact area of the box from the axle due to a change of the cross-section of different boxes the different boxes move a longer or shorter distance along the guideways until they reach their respective dispensing position.

According to one embodiment of the invention the box is built in a multifunctional manner: during transportation the box serves as a protecting sheet, wherein the roll is protected against dirt and/or damages of the items. Additionally, it could be a problem to stack several rolls due to a circular cross-section. According to a specific embodiment of the invention the box can be built with flat walls increasing the ability of stacking several boxes. Furthermore, the box also protects the items against dirt and/or damages in the dispensing position. Additionally, the box can have a fancy design covering the roll of the items. Furthermore the box can be used for advertising or giving information about the items, the assembly of the box with the holding device, for the use of the box and/or for disposal of used items.

The components of the embodiments of the invention can be produced in a very economic way. The box can be built of cardboard, corrugated board, paper and the like. Such materials have a low weight, can be produced with low costs and can be formed in a very simple way. In particular the box is made of a folded or upright tailored piece of cardboard, corrugated board and the like. Furthermore, a box produced of the aforementioned materials can be disposed in a very simple way and compatible to the environment. The holding device can be produced of well-known semi-finished products, in particular with a (guiding) axle made of metal or plastic and/or side arms built of sheet metal.

According to the invention the feature axle covers every elongate elements extending through the roll and being designed and configured to support the roll. The axle may be fixed with respect to the box and/or the holding device or could be rotatably linked with at least one of the roll, the box and the holding device.

According to another embodiment of the invention, the front walls of the box are to the greatest possible extent closed during transportation. The front walls include a weakening, a carving, a perforation, a fold and/or a marker that forms the opening in the dispensing position. A transfer of the box from the transportation position to the dispensing position can be achieved by mechanical operation of the weakening, the carving, the perforation, the fold or the marker, such that the openings are attained. The operation can be realized by hand or by means of the axle. Due to the fact that the front walls are closed as far as possible during transportation, any dirt and/or mechanical damages are avoided that could occur during transportation in case of the box had the openings. Only immediately before the use in the garages, the openings are formed. By means of insertion of the axle the openings can be closed at once so that any deterioration of the protecting function of the box in the area of the side walls and the opening is limited to a minimum.

According to another embodiment of the invention, the front walls include supporting elements rotatably supporting the roll. These embodiments are suitable to incorporate the advantages of such supporting elements known from common embodiments as patent applications and patents US 20040016668 A1, U.S. Pat. No. 3,302,781, DE 101 19 821 A1, U.S. Pat. No. 3,565,307 and U.S. Pat. No. 5,971,150. Such supporting elements provide for an exact alignment of the roll and contribute to a decrease of frictional forces between the front walls of the box and the roll.

It is also possible that the box comprises a dispensing chamber. The dispensing chamber is defined between the box and the roll. Additionally a receiving chamber is provided. The receiving chamber is defined by the hollow interior of the roll, recesses of supporting elements and the opening. The receiving chamber serves to receive the axle. Particles of dirt originating from the exterior of the box have to pass the openings and the receiving chamber in order to reach the dispensing chamber where they could contaminate the roll and the items. However, between the dispensing chamber and the receiving chamber transmission areas are located. The transmission areas are designed and arranged such that the particles are prevented from entering said dispensing chamber from said receiving chamber. This can for example be provided by the supporting elements having protrusions extending from the front walls into the hollow interior of the roll such that the transmission areas are built by the contact area or a small gap between the aforementioned protrusions and the roll or a bobbin of the roll. On the other hand the chambers and the transmission area may build a kind of labyrinth seal. Accordingly, this embodiment of the invention builds a system with "multiple chambers" for the protection against contamination.

There are many different possible designs and choices of the material properties of the used components. According to one special embodiment of the invention, the material between the contact area and the openings as well as between the contact area and the places where the forces are introduced during dispensing of the items are sufficiently stiff. Otherwise dispensing of the items would lead to undesired deformations of the box. Those deformations could lead to a (small) rotation of the box with respect to the holding device which coincides with the deformation of the box. In case that the box has a square or rectangular cross-section, according to the invention the walls of the box remain approximately perpendicular in the corner areas adjacent to the contact areas during exertion of forces by a user.

Furthermore, it is possible that the side arms of the holding device each include a plurality of guideways. The plurality of guideways is used to support boxes in different dispensing positions. Accordingly, different boxes can be positioned in different heights. This can be useful for users of different body heights. Alternatively or additionally it is possible to support a series of boxes by means of the same holding device. The series of boxes can be built by boxes of the same type, so that additional boxes are available for dispensing more items at the same time or for providing substitutes. It is also possible that the holding device is used for boxes of different lengths and/or sizes and cross-sections, so that for example items of different types and different sizes can be provided by the same assembly. In particular the holding device comprises two sheet metals comprising an L-shaped cross-section. One arm of the sheet metal can be mounted with the wall of the garage or a fitment of the garage, whereas the other arm builds the side arm containing the guideway(s). The distance of the two sheet metals correlates with the width of the box being received between the sheet metals. In particular there is a small gap between the sheet metals and the box in order to provide an easy motion of the box along the guideways.

Alternatively it is possible that the holding device is built by a U-shaped sheet metal, wherein a middle or base arm of the U-shaped sheet metal builds the contact area of the holding device and the two side arms of the U-shaped sheet metal contain the guideways. The aforementioned sheet metals may be simple semi-finished products.

Other features and advantages of the present invention will become apparent to one with skill in the art upon examination of the following drawings and the detailed description. It is intended that all such additional features and advantages be included herein within the scope of the present invention, as defined by the claims.

BRIEF DESCRIPTION OF THE DRAWINGS

The invention can be better understood with reference to the following drawings. The components in the drawings are not necessarily to scale, emphasis instead being placed upon clearly illustrating the principles of the present invention. In the drawings, like reference numerals designate corresponding parts throughout the several views.

DETAILED DESCRIPTION

Figure 1:
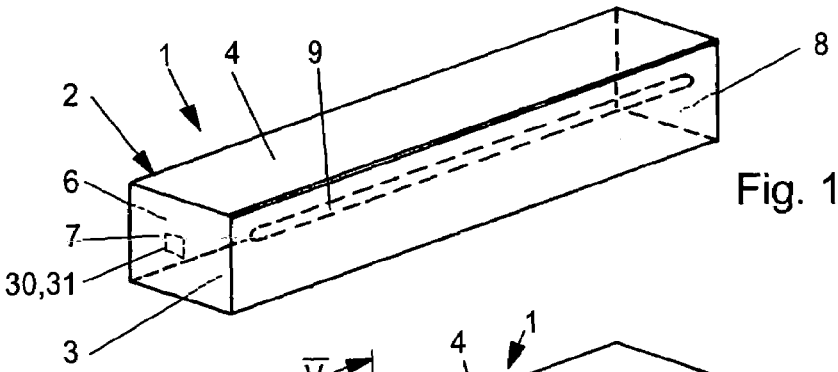
FIG. 1 is a perspective view of the novel transportation and dispenser box in a transportation condition.

Referring now in greater detail to the drawings, FIG. 1 illustrates a transportation and dispenser box 1 being made of a portion 2 of cardboard, corrugated board and the like. The transportation and dispenser box 1 includes a lower bottom wall 3, an upper bottom wall 4, a front vertical side wall 5, a rear vertical side wall 6 and two front walls 7 and 8. A perforation strip 9 is arranged in the upper half of the front vertical side wall 5, the perforated strip 9 being designed and arranged to be removed from the box 1 such that a slot 10 is formed as illustrated in FIG. 2.

Figure 2:
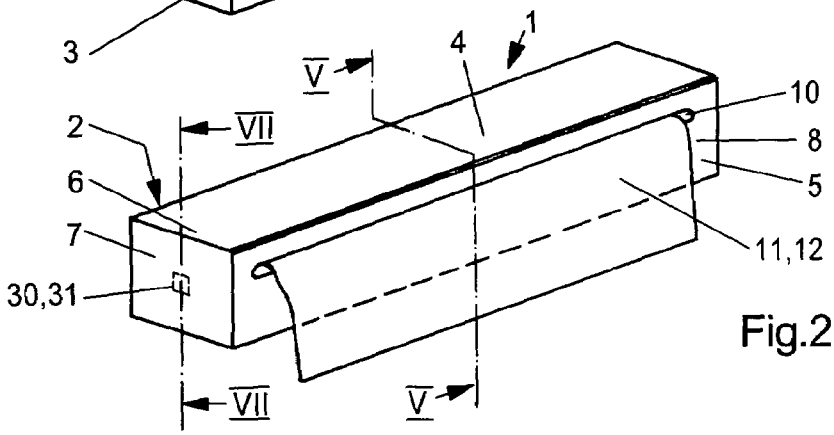
FIG. 2 is a view of the novel transportation and dispenser box of FIG. 1 in a dispensing position.

FIG. 2 illustrates the box 1 in the dispensing position and its ready-to-be-used position, respectively. The end of an elongated path of material or a sheet material 11 being formed by a plurality of items 12 being interconnected by perforations protrudes out of the box 1. For example, these items 12 may be seat covers made of plastic foil as they are commonly used to protect seats of an automobile during repairing and servicing the automobile in a garage to prevent soiling of the seats. These seat covers and this sheet material 11, respectively, have a certain width of approximately between 60 cm and 1 m.

Figure 3:
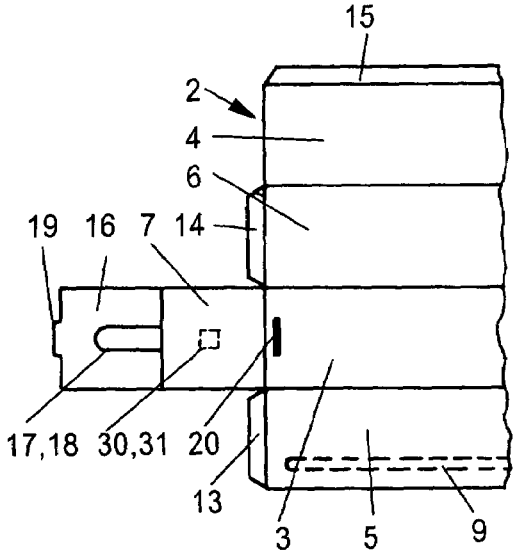
FIG. 3 is a semi-sectional view of the unfolded portion of which a first exemplary embodiment of the novel transportation and dispenser box is to be formed.

FIG. 3 explains the design of the portion 2 for forming the transportation and dispenser box according to FIGS. 1 and 2 by the portion 2 being unfold to be located in one plane. It is to be seen that the side walls 5 and 6 are connected to the lower bottom wall 3 by fold lines. The side walls 5 and 6 include lateral connection flaps 13 and 14 to be connected with the associated elements of the portion 2 in the upright position. The upper bottom wall 4 is connected to the side wall 6 by another fold line. The upper bottom wall 4 is connected to the closing flap 15 by a fold line such that the closing flap 15 is pivotable.

Since the walls 3, 4, 5, 6 have the same height, it is imaginable that there is a square cross-section in the upright position of the box 1. Front walls 7 and 8 are connected to both sides of the lower bottom wall 3 by fold lines. A supporting wall 16 is connected to each front wall 7 and 8 by another fold line. A portion 17 is located in the supporting wall 16, the portion 17 forming a supporting element 18. Additionally, the supporting wall 16 in its outer region includes a protrusion 19. The lower bottom wall 3 includes a punched out element 20 being associated with the protrusion 19 and being engaged by the protrusion 19 in the upright position such that the front wall 7 and the supporting wall 16 are fixed in a parallel orientation at the end of the transportation and dispenser box.

Figure 4:
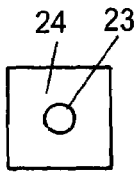
FIG. 4 is a view of a separate supporting wall having a plate-like design to be inserted into the box.

FIG. 4 shows a single plate-like supporting wall 24. For example, the supporting wall 24 is designed as a square section of corrugated cardboard including the opening 23 being located in the center region such that one supporting wall 24 is pushed upon the ends of each bush or bobbin 22 during insertion of the roll 21. The unit resulting therefrom is inserted into the upright transportation and dispenser box in a downward direction. It is to be understood that the front walls 7 and 8 do not include openings 23 when being used in combination with the supporting walls 24 when it is desired to realize the above described centering effect. However, it is also possible to arrange additional openings 23 in the front walls 7 and 8 to enlarge the width of the respective support of the bobbin 22 in the lateral supporting elements 18. When using rolls with flexible items being wound up to different diameters such a centering function is advantageous. If a roll with a very small diameter is used the bobbin 22 with the wound up items 11 would not be aligned in the box 1 in the position of the openings 23 so that insertion of axle 32 would be hindered. It is also possible to arrange additional openings 23 in the front walls 7 and 8 to enlarge the width of the respective support of the bobbin 22 in the lateral supporting elements 18. The use of such separate supporting walls 24 which may also be fixed in the upright position 2 provides for the advantage of the portion 2 not necessarily being made of double corrugated cardboard box. Instead, single corrugated cardboard box is sufficient since additional stiffening effects are attained due to the inserted supporting walls 24. The supporting walls 24 may also include an opening having a shape as it is to be seen from FIG. 3.

The front walls 7, 8 each comprise openings 30. The openings 30 of respective front walls 7, 8 are aligned with each other and centered with respect to the front walls 7, 8. However, instead of openings 30 markers 31 can be provided. Other alternatives may comprise a weakening of the front walls 7, 8, carving, perforations or a fold at locations, where a user later forms the openings 30 in the front walls 7, 8 when transferring the box from a closed transportation position to the dispensing position. For double-sided walls built by front wall 7 and supporting wall 16 or supporting wall 24 markers 31 and the like may only be built in the exterior wall.

Figure 5:
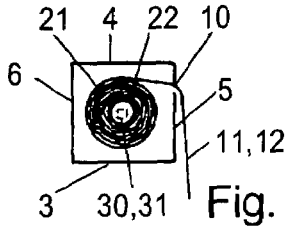
FIG. 5 is a sectional view along line V-V of FIG. 2 with an upper outlet.
Figure 7:
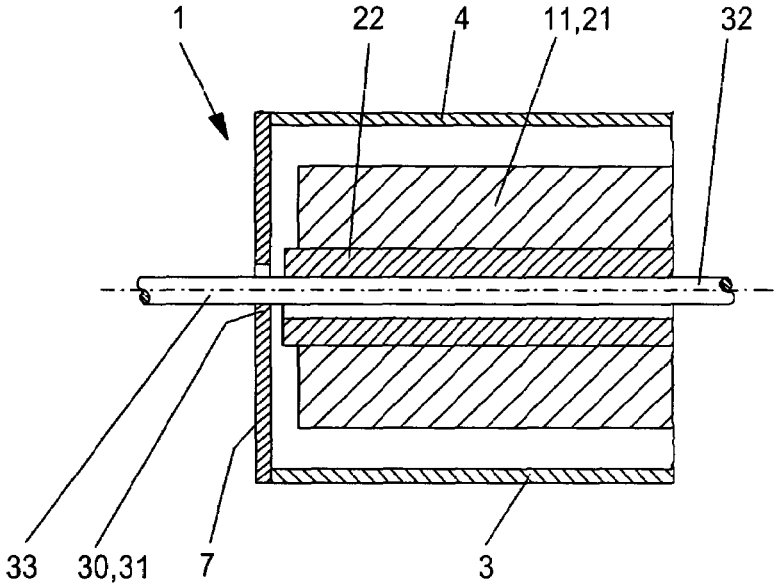
FIG. 7 is a longitudinal sectional view showing a transportation and dispenser box with an opening, an axle and a roll wound up on a bobbin.

It is to be seen from FIGS. 5 and 7 that the sheet material 11 is located in the interior of the transportation and dispenser box 1. The sheet material 11 is wound up to form a roll 21 being located on a bush or bobbin 22. It is to be seen from FIG. 7 that the bobbin 22 has a width being more than the width of the sheet material 11 and the roll 21 such that the bobbin 22 protrudes with respect to the roll 21 at both sides. Consequently, the roll 21 may be freely suspended on the bobbin 22 at both sides being supported at supporting elements 18. FIGS. 5 and 7 illustrate the roll 21 being supported by the supporting elements 18 to be suspended to be freely rotatable. The roll 21 does not contact the inner side of the bottom walls 3 and 4 and the side walls 5 and 6. Since the front walls 7 and 8 in combination with the supporting walls 16 also have a centering effect with respect to the bobbin 22, it is ensured that there is no frictional contact of the supporting walls 16 to the material of the sheet material 11 and of the roll 21, respectively. Thus, the roll 21 may be easily rotated when pulling the front end of the sheet material 11 through the slot 10. FIGS. 2 and 5 illustrate the roll 21 being supported in this way in the transportation and dispenser box 1 and exiting the box in an upper region. The perforation strip element 9 and the slot 10 are located in the middle portion of the upper half of the front side wall 5. It may be seen from FIG. 5 that the sheet material 11 is pulled out of the box 1 in an approximately tangential direction such that the end of the sheet material 11 exiting the box 1 through the slot 10 is directed by approximately 90°. When the sheet material 11 has a design such that it has a comparatively smooth outer surface and a comparatively rough inner surface, the rough surface is used in an advantageous way when contacting the lower edge of the slot 10 during separation of the perforated portions during removal of an item 12 from the elongated sheet material 11.

The above described way of suspending the bobbin 22 to be freely rotatable in the supporting elements 18 is not only realized when a few items 12 have been removed from the sheet material 11. The bobbin 22 may already be freely rotatable when a complete roll 21 is inserted into such a transportation and dispenser box 1 and during transportation of the box 1. However, it is not disadvantageous to choose the size of the diameter of the roll 21 and the size of the square interior of the transportation and dispenser box 1 such that the roll 21 being elastic in a certain way initially contacts the inner walls of the box 1. However, there is no contact after having removed a few items 12 resulting in a reduction of the diameter of the roll 21. Such rolls 21 may include up to approximately 500 or more items 12 being interconnected by perforations. The number of items 12 depends on the wall thickness and potential longitudinal folds of the items 12 and from the size of the box 1.

Figure 6:
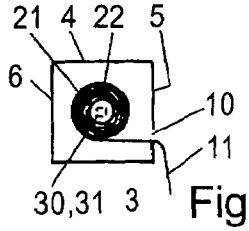
FIG. 6 is a similar view as FIG. 6, but showing a lower outlet.

FIG. 6 illustrates the roll 21 being located in the transportation and dispenser box 1 in an opposite direction compared to FIG. 5, meaning a design in which the items 12 are removed in the lower region of the box 1. The slot 10 is located in the lower portion of half of the height of the side wall 5 to allow for tangential removal in combination with a deflection of the sheet material 11 by approximately 90° when exiting the box 1 through the slot 10.

The supporting elements 18 may not only be realized by a separate supporting wall 16, as this is illustrated in FIG. 3.

As to be seen from FIG. 7 an axle 32 is passed through openings 30 of the transportation and dispenser box 1 and through bobbin 22, so that end regions of axle 32 which build guiding elements 33 protrude out of the transportation and dispenser box 1. There is a play or backlash between the axle 32 and the interior of the hollow bobbin 22, so that the axle 32 is to be introduced in a simple manner. When providing markers 31, perforations or folds instead of the openings 30 a better protection during transportation is provided. However, when transferring the transportation and dispenser box to the dispensing position, it is necessary to form the openings 30 by thrusting through front walls 7, 8.

Figure 8:
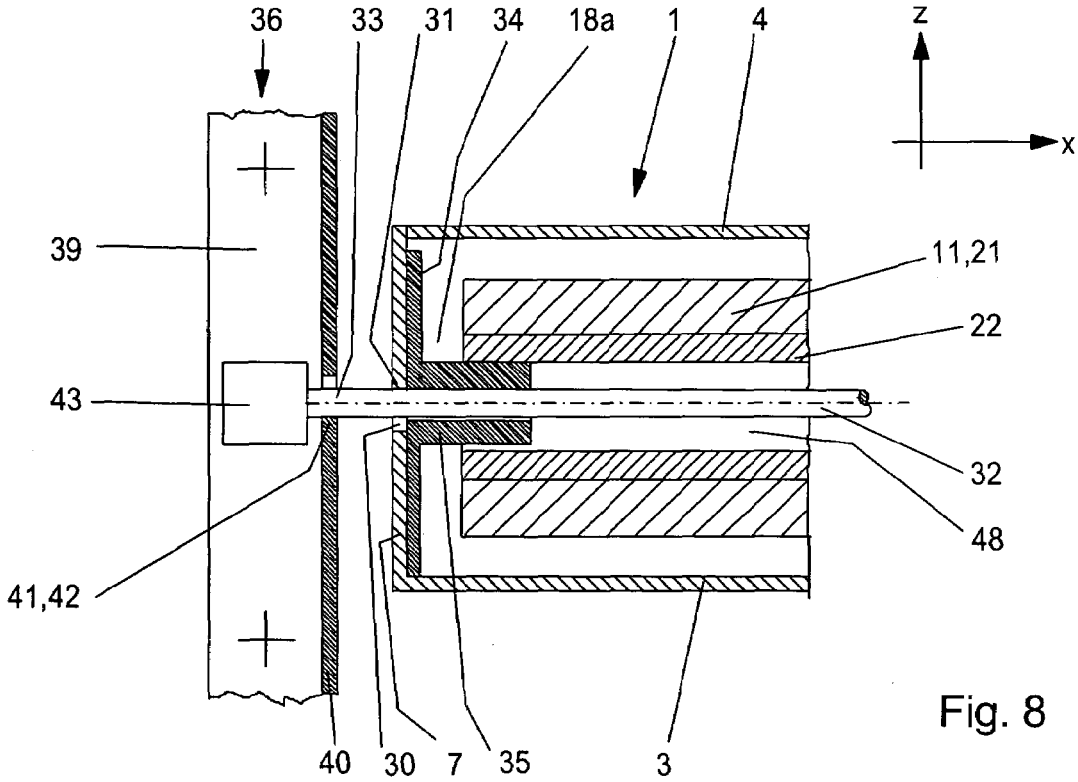
FIG. 8 is a longitudinal sectional view showing a box with supporting elements and a roll supported by a holding device.

According to the embodiment shown in FIG. 8 the transport and dispenser box 1 comprises supporting elements 18*a*. The supporting elements 18*a* are built by a part of a mold made of plastic and are located adjacent to front walls 7, 8. Additionally, the molds 34 can be fixed with respect to the front walls 7, 8. Each part of a mold 34 includes a hollow cylindrical protrusion 35. The protrusions 35 extend from the front walls 7, 8 into the interior of bobbin 22. The protrusions 35 build a rotatable support for the roll 21 and the bobbin 22. In assembled condition the force flow of the weight of the roll 21 passes from bobbin 22 over protrusion 35 via axle 32 to a holding device 36.

Figure 9:
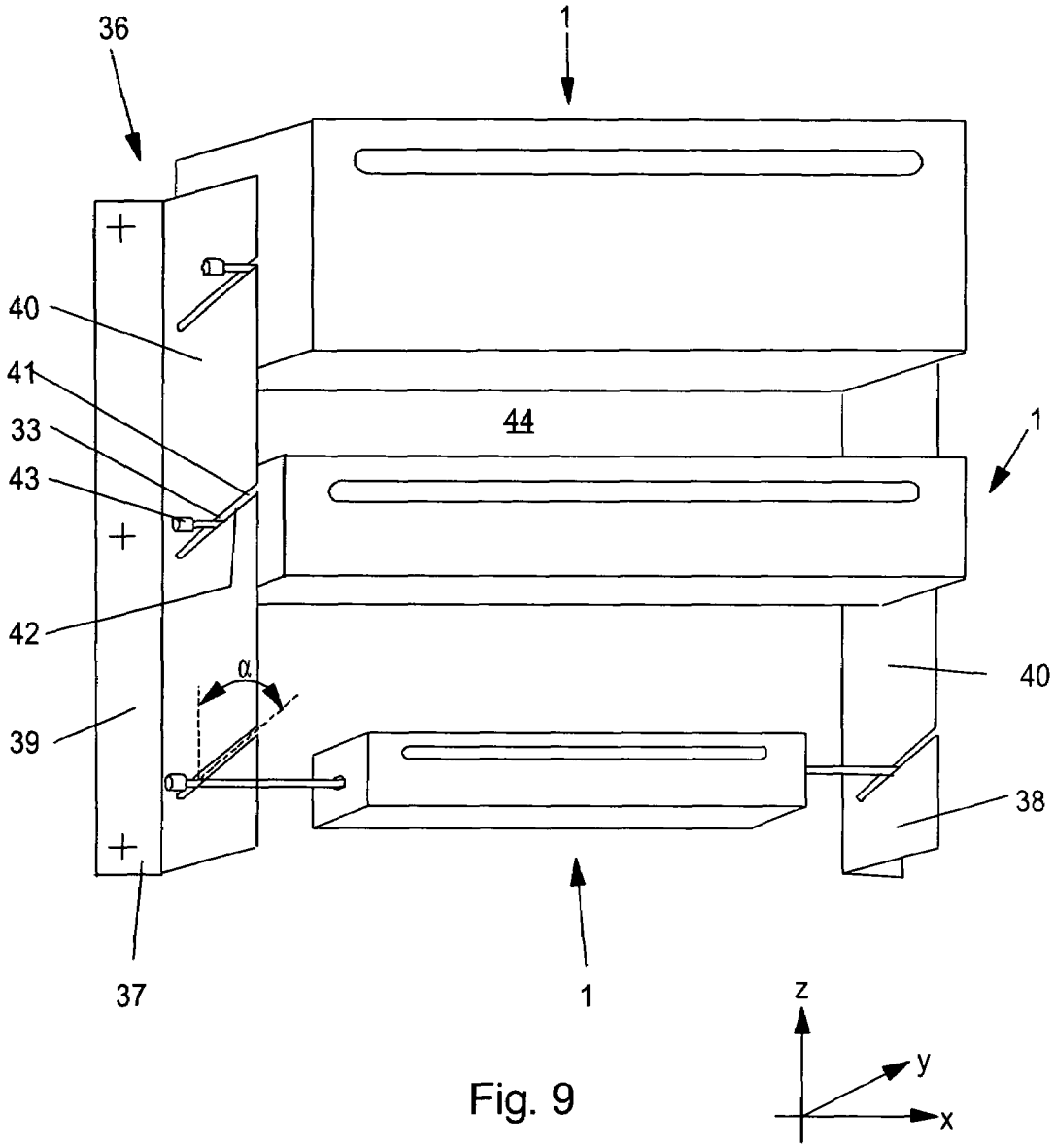
FIG. 9 is a view of a novel assembly with a holding device supporting three boxes of different lengths and cross-sections.

FIGS. 8 and 9 show a first embodiment of a holding device 36. The holding device 36 includes two sheet metals 37, 38 with an angled cross-section comprising a base arm 39 and a side arm 40. The sheet metals 37, 38 have an L-shaped cross-section. The base arms of the sheet metals 37, 38 are screwed with a vertical wall of the garage. The side arms 40 are parallel with each other so that between the side arms 40 the transportation and dispenser box 1 may be received. At the same positions the side arms 40 comprise guiding slots 41 having the same orientation or contour, wherein the guiding slots 41 extend from the end region of side arms 40 being located opposite to the base arm 39. In the plane of side arm 40 the guiding slots 41 build an angle with a vertical axis (plane y-z, see FIG. 9), which is between 0° and 90°. The angle according to a specific embodiment is chosen to be between 30° and 60°, in particular between approximately 40° and 50°. The lower limitation of guiding slot 41 builds a guiding path 42 for the axle 32.

For an assembly of the transportation and dispenser box 1 and the holding device 36 the guiding elements 33 of the axle 32 are inserted into the guiding slots 41 of the metal sheets 37, 38. Due to gravity the guiding elements 33 move along the guiding path 42 in a slanting motion. In the end regions extending outside the holding device the axle 32 includes stops 43 to limit a lateral displacement of axle 32 due to any movement of the transportation and dispenser box 1 or of the axle 32 in direction of axis x. The stops 34 can be built as protrusions or collars of axle 32. However, it is also possible that the stops 43 are built by separate parts being screwed, attached or pinned with or to the axle 32.

Due to gravity the transportation and dispenser box 1 or due to additional forces of the user the transportation and dispenser box 1 and the axle 32 move along guiding path 42. In an end position the rearward wall 6 of the transportation and dispenser box 1 abuts wall 44 wherein wall 44 is built by a wall of the garage, a cupboard of the garage, the base arm 39 and the like.

According to the embodiment shown in FIG. 9, the holding device 36 serves to support three transportation and dispenser boxes 1 of different lengths and/or different cross-sections. Correlating with the cross-section of the transportation and dispenser boxes the guiding elements 33 of different transportation and dispenser boxes 1 are moved different distances along the guiding slots 41. The holding device 36 includes a plurality of pairs of guiding slots 41 located in alignment with each other and in different heights.

Figure 10:
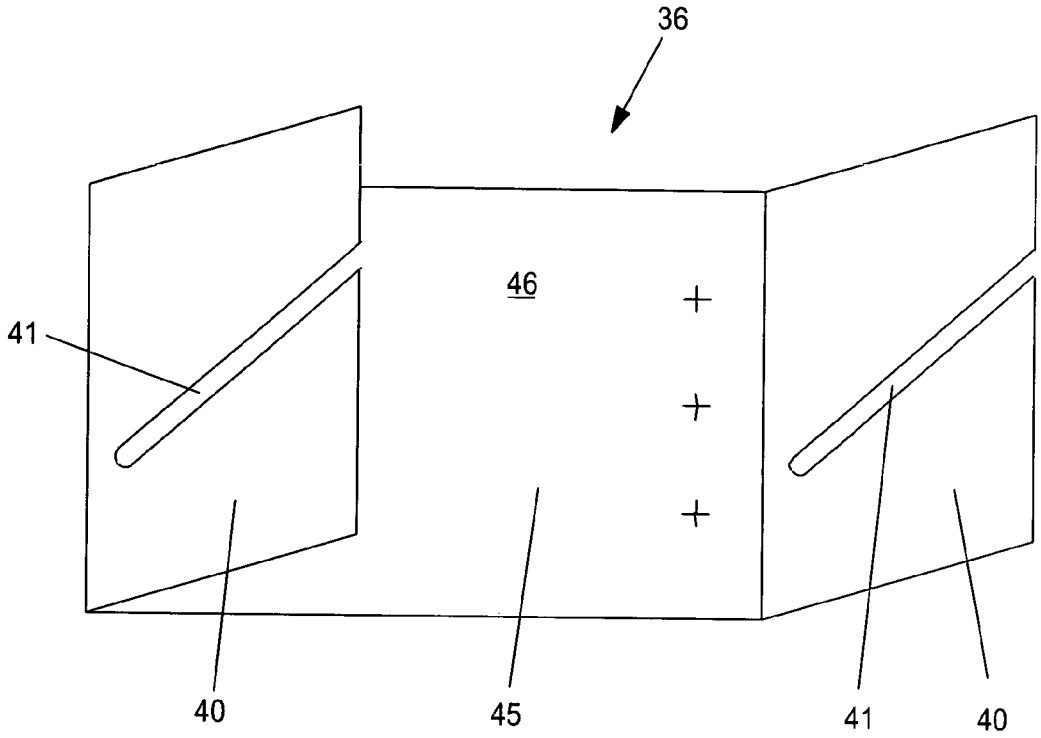
FIG. 10 is a perspective view of a holding device formed by a U-shaped sheet metal.

An alternative embodiment of the holding device 36 is shown in FIG. 10. The holding device 36 comprises a U-shaped horizontal cross-section. The holding device 36 includes a continuous middle arm 45, which is used for fixing the holding device 36 with respect to the surrounding walls. Furthermore, the holding device 36 includes two side arms 40 each having at least one guiding slot 41. The middle arm 45 includes a supporting area 46. In the end position the transportation and dispenser box abuts the supporting area 46 and serves to prevent any rotation of the transportation and dispenser box 1.

Figure 11:
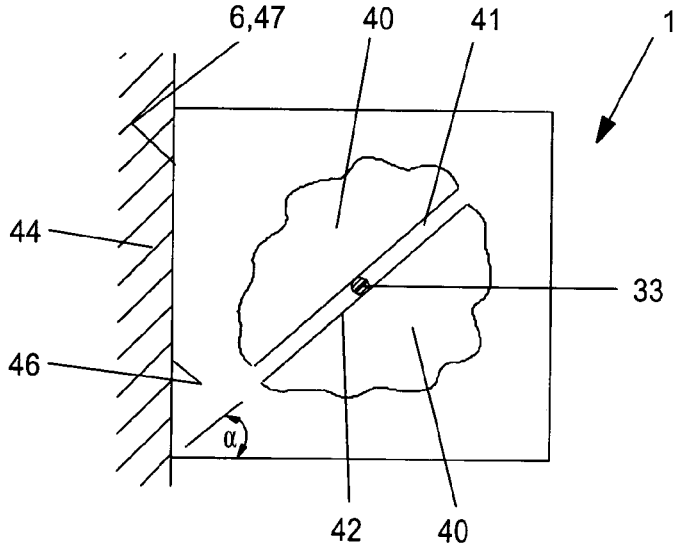
FIG. 11 is a semi-sectional view taken transverse to the longitudinal direction of the box showing the interaction between the axle and the guideways.

FIG. 11 shows a semi-partial cross-sectional view of the embodiment according to FIG. 9. Contact area 47 of the rearward side wall 6 contacts supporting area 46 of wall 44 in its entirety or only in a partial region.

As to be seen from FIG. 8, opening 30 builds an opening towards the receiving chamber 48, wherein the receiving chamber 48 is limited by bobbin 22 and protrusion 35. A transfer of particles of dirt from the environment into the receiving chamber 48 and from receiving chamber 48 to the roll 21 is only possible in case of the particles passing through the gap between protrusion 35 and bobbin 22.

Figure 12:
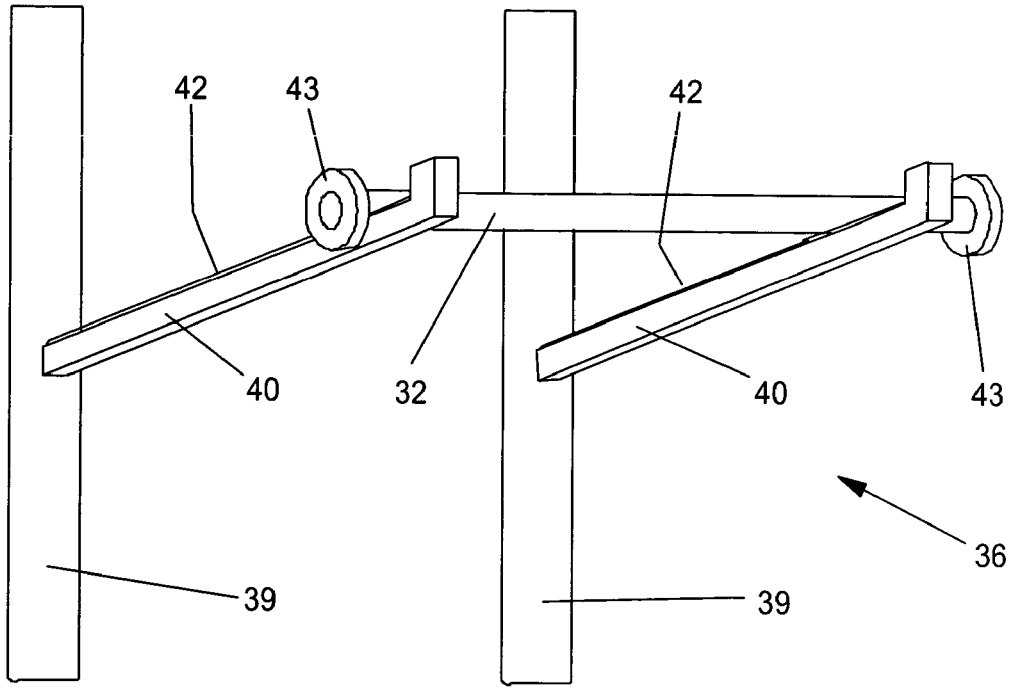
FIG. 12 shows another embodiment of a holding device.
Figure 13:
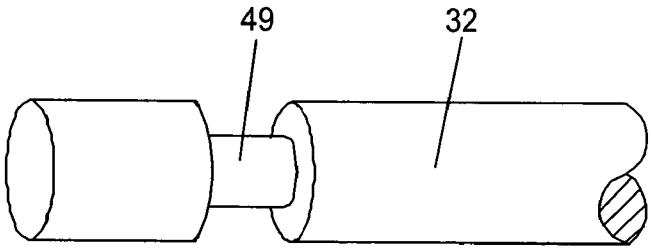
FIG. 13 shows an end region of a modified axle of the holding device according to FIG. 12.

The embodiment of the holding device 36 according to FIG. 12 comprises two base arms 39 for a fixation of the holding device with respect to a wall of the garage. The side arms 40 inclined by an angle are built by a carrier or console, wherein the upper surface of the carrier or console builds the guiding path 42. For simplification only the axle 32 is shown, here with detachable stops 43. After detaching at least one stop 43, the axle 32 is passed through the openings 30 or markers 31 of the transportation and dispenser box 1 and through bobbin 22 with roll 21. The unit built by axle 32, transportation and dispenser box 1, roll 21, bobbin 22 is "hung up" or suspended by means of the carrier and the holding device. When inserted into the guiding path 42, the aforementioned unit automatically moves to reach the end position in which the unit is secured against rotation as explained with respect to FIG. 9.

Instead of the detachable stops 43 both ends of axle 32 may also include a circumferential groove or slot 49. Also only one circumferential groove or slot 49 may be sufficient. Such an embodiment simplifies passing the axle 32 through the openings and the bobbin.

Many variations and modifications may be made to the preferred embodiments of the invention without departing substantially from the spirit and principles of the invention. All such modifications and variations are intended to be included herein within the scope of the present invention, as defined by the following claims.

I claim:

1. An assembly for containing, protecting and dispensing flexible items to be used in garages, comprising:

a box including a plurality of interconnected flexible items, said flexible items being wound up to form a roll having an axially extending hollow interior, a plurality of front walls and at least one contacting area, said contacting area being designed and arranged to secure said box against rotation, said front walls at least partly being made of a material selected from the group consisting of cardboard and corrugated board, each of said front walls being designed to include a receiving element selected from the group consisting of an opening, a marker, a weakening, a carving, a perforation and a fold, said receiving elements being designed and arranged to be approximately centered with respect to said front walls, said receiving elements being designed and arranged to be axially aligned with respect to each other, said receiving elements being designed and arranged to receive an axle to be passed through said receiving elements and through said roll in a dispensing position of said box; and a holding device, said holding device being designed and arranged to suspend said box in a dispensing position, said holding device including an axle to be passed through said roll in the dispensing position, said holding device including a plurality of side arms, said side arms being designed and arranged to surround said front walls of said box, said side arms being orientated approximately perpendicular with respect to said axle, each of said side arms including at least one guideway, said guideways being designed and arranged to receive said axle, said guideways at least partly being inclined with respect to a vertical axis at an angle of more than 0° and less than 90° such that said roll is supported by both said contacting area of said box and by said axle.

2. The assembly of claim 1, wherein said holding device includes at least one arm being designed and configured to be fixedly connected to a wall of a garage, a supporting area being designed and arranged to contact said contacting area of said box and being orientated approximately perpendicular with respect to said side arms.

3. The assembly of claim 2, wherein said side arms include a plurality of pairs of guideways being designed and arranged to support said at least one box in a plurality of alternative dispensing positions.

4. The assembly of claim 1, wherein said side arms include a plurality of pairs of guideways being designed and arranged to support said at least one box in a plurality of alternative dispensing positions.

5. The assembly of claim 1, wherein each of said guideways is designed as a guiding slot, said guiding slot being designed and arranged to slidably receive said axle.

6. The assembly of claim 1, wherein said holding device includes two L-shaped sheet metal elements having a first and a second arm, said first arm being designed and arranged to be fixedly connected to a wall of the garage and said second arm forming said side arm.

7. The assembly of claim 1, wherein said holding device comprises a U-shaped sheet metal with a central arm and two side arms, wherein said central arm forms a contacting area of said holding device and said side arms contain said guideways.

8. The assembly of claim 1, wherein said front walls are configured to attain a transportation position, said receiving elements initially being at least partly closed and being adapted and designed to be transformed to form an opening for receiving said axle in said dispensing position.

9. The assembly of claim 1, wherein each one of said front walls includes a supporting element, said supporting element having a recess being designed and arranged to receive the axle and to allow for support of said roll in a way that said roll is rotatable.

10. The assembly of claim 1, wherein regions of said box being located between said contacting area and said openings are designed and configured to be stiff and to have a moment of inertia which is sufficient to withstand forces acting upon said box during dispensing of said items.

* * * * *